US009744653B2

(12) United States Patent
Vaale

(10) Patent No.: US 9,744,653 B2
(45) Date of Patent: Aug. 29, 2017

(54) APPARATUS HAVING AN ADJUSTABLE LOCKING PLIER BODY AND A SPLIT JAW

(71) Applicant: Lee Edward Vaale, Oakland, MN (US)

(72) Inventor: Lee Edward Vaale, Oakland, MN (US)

( * ) Notice: Subject to any disclaimer, the term of this patent is extended or adjusted under 35 U.S.C. 154(b) by 285 days.

(21) Appl. No.: 14/588,834

(22) Filed: Jan. 2, 2015

(65) Prior Publication Data

US 2016/0193720 A1 Jul. 7, 2016

(51) Int. Cl.

| | |
|---|---|
| ***B25B 7/02*** | (2006.01) |
| ***B25B 13/06*** | (2006.01) |
| ***B25B 13/46*** | (2006.01) |
| ***B25B 23/00*** | (2006.01) |
| ***B25B 7/12*** | (2006.01) |

(52) U.S. Cl.
CPC ..... *B25B 23/0085* (2013.01); *B25B 7/123* (2013.01)

(58) Field of Classification Search
CPC ..... B25B 23/0085; B25B 7/123; B25B 7/02; B25B 5/12; B25B 13/46; B25B 13/06
See application file for complete search history.

(56) References Cited

U.S. PATENT DOCUMENTS

| | | | | | |
|---|---|---|---|---|---|
| 64,904 | A * | 5/1867 | Perry et al. | B25B 23/0085 | 294/3 |
| 80,998 | A * | 8/1868 | Phelps | B25B 23/0085 | 29/218 |
| 104,264 | A * | 6/1870 | Butterfield | B25B 23/0085 | 81/13 |
| 1,900,314 | A * | 3/1933 | Strom | B25B 1/04 | 269/246 |
| 4,776,079 | A * | 10/1988 | Cameron | B25B 5/12 | 29/268 |
| 4,881,434 | A | 11/1989 | Keller | | |
| D333,771 | S * | 3/1993 | Aoki | D8/72 | |
| 5,501,126 | A * | 3/1996 | Wright | B25B 7/00 | 81/302 |
| 5,788,809 | A * | 8/1998 | Brennan | B25B 5/163 | 156/580 |
| 5,931,453 | A * | 8/1999 | Brennan | B25B 5/163 | 269/258 |
| 5,937,716 | A | 8/1999 | Klann | | |
| 6,438,817 | B1 | 8/2002 | Pongratz | | |
| 6,698,314 | B1 * | 3/2004 | Nichols | B25B 13/463 | 81/420 |
| 7,237,425 | B1 * | 7/2007 | Wadsworth | B25B 5/003 | 269/154 |
| 7,311,024 | B1 * | 12/2007 | Piel | B25B 7/123 | 81/418 |
| 7,984,895 | B2 | 7/2011 | Strauss et al. | | |
| 8,109,183 | B2 | 2/2012 | Santamarina et al. | | |
| 8,122,792 | B2 | 2/2012 | Engvall et al. | | |
| 2004/0255730 | A1 * | 12/2004 | Noniewicz | B25B 7/02 | 81/418 |

* cited by examiner

*Primary Examiner* — David B Thomas
(74) *Attorney, Agent, or Firm* — Ariel S. Bentolila; Bay Area IP Group LLC

(57) ABSTRACT

An apparatus comprises an adjustable locking plier body. A split jaw top is joined to the plier body. The split jaw top comprises a left jaw and a right jaw. The left jaw and the right jaw are separated by a distance. A bottom jaw is joined to the plier body. The bottom jaw is generally centered on the distance, wherein the bottom jaw and the split top jaw are operative for clamping a work piece inserted between the bottom jaw and the split jaw top.

15 Claims, 5 Drawing Sheets

APPARATUS HAVING AN ADJUSTABLE LOCKING PLIER BODY AND A SPLIT JAW

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to adjustable, locking pliers. More particularly, the invention relates to a tool that holds two or more parts together on the same plane to prevent a bolt from turning or tipping while leaving both hands free to install or to remove a bolt and nut.

BACKGROUND OF THE INVENTION

The following background information may present examples of specific aspects of the prior art (i.e. without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

When installing or removing a bolt and a nut in a mechanical device, the user typically must hold the bolt in one hand with a tool to prevent movement, while the nut is turned with another tool held with the user's other hand. This task can be difficult and may damage either the bolt head or the nut if the tool slips under pressure. The likelihood of damage is substantially increased if the bolt is rusted, if the threads are damaged, or if a lock nut is being used. Additionally, attempting to hold two or more tools while placing a bolt and nut in position can make this problem even more difficult. Some currently available solutions may provide mechanical devices that incorporate clamps and swivel-jaw assemblies that pivot on fixed assemblies at pivot connections with levers that lock the jaws in the clamping positions, or that act as impact drivers and use multiple fastening bits.

However, these solutions are not versatile enough to handle a diversity of work pieces. Moreover, none of these solutions uses specially designed sockets to engage the bolt head on six sides and the top or, in conjunction with the swivel pads, allows the socket to be used from any of the three contact points. Further, none of these solutions frees the user's hands to work on the bolt and nut with the proper leverage or allows placement of the top jaws for unrestricted access to the threaded bolt and nut.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. One such aspect of the prior art is a clamp that comprises a rotatable jaw. Another generally useful aspect of the prior art is that of an impact-resistant tool-holder or tool-bit holder that has an active end for driving a fastener and a shanking end that may be attached to a power tool. Yet another aspect of the prior art is a self-adjusting locking pliers with a fixed jaw. However, these solutions may not provide a device that prevents the movement of a bolt so that the user can install or remove a nut. A solution that does so would be desirable.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIGS. 1A, 1B and 1C are illustrations of an exemplary device that holds two or more parts together on the same plane to prevent a bolt from turning or tipping while leaving both hands free to install or to remove a nut, in which FIG. 1A is a top view, FIG. 1B is a side view, and FIG. 1C is an angle view, in accordance with an embodiment of the present invention;

Figure 1A:
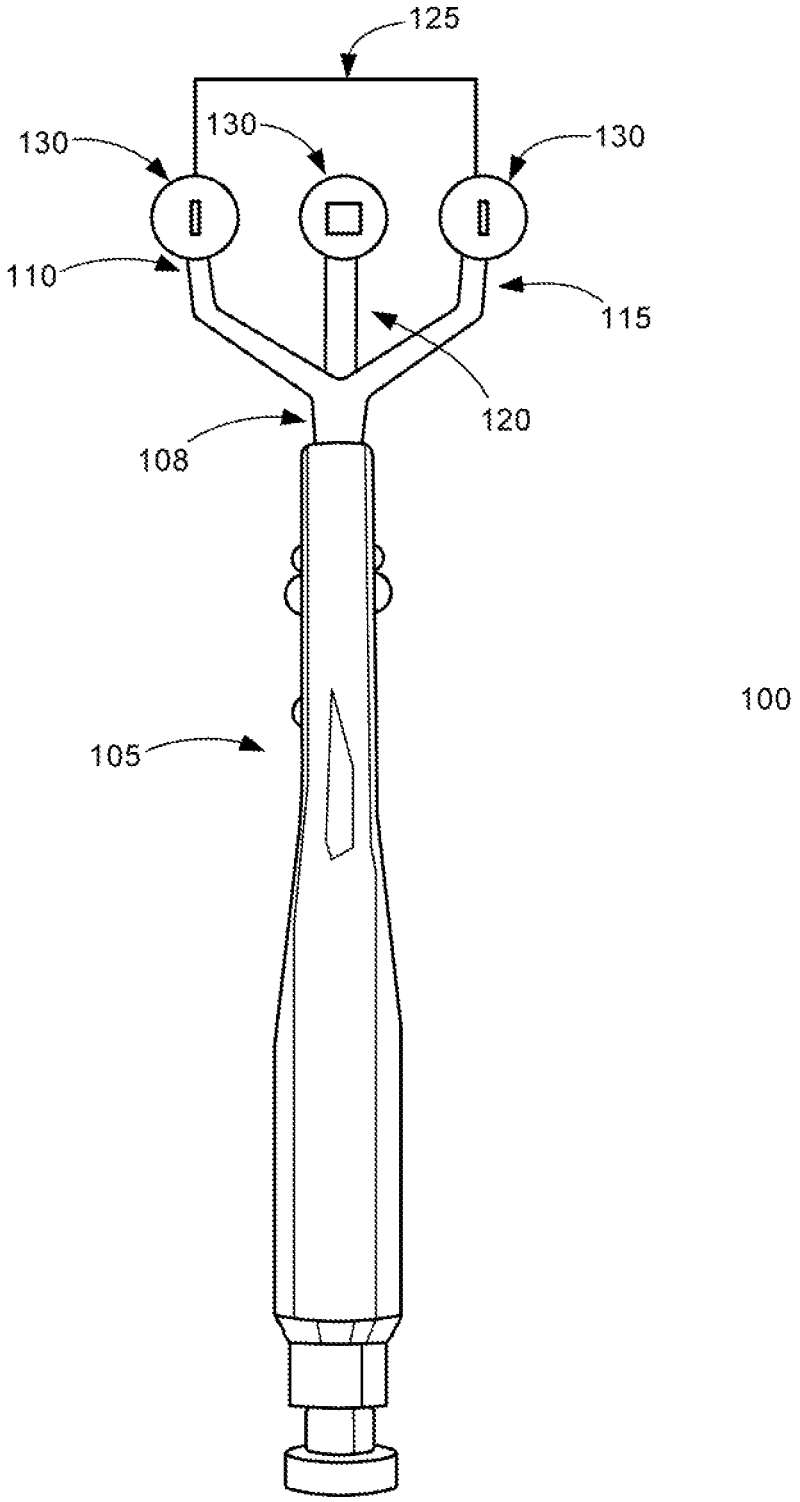

Unless otherwise indicated, illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein describes particular embodiments only, and is not intended to limit the scope of the present invention. It must be noted that, as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention may be suitable for various sized bolts and nuts with variable corrosion or thread damage or the addition of lock nuts.

Figure 1B:
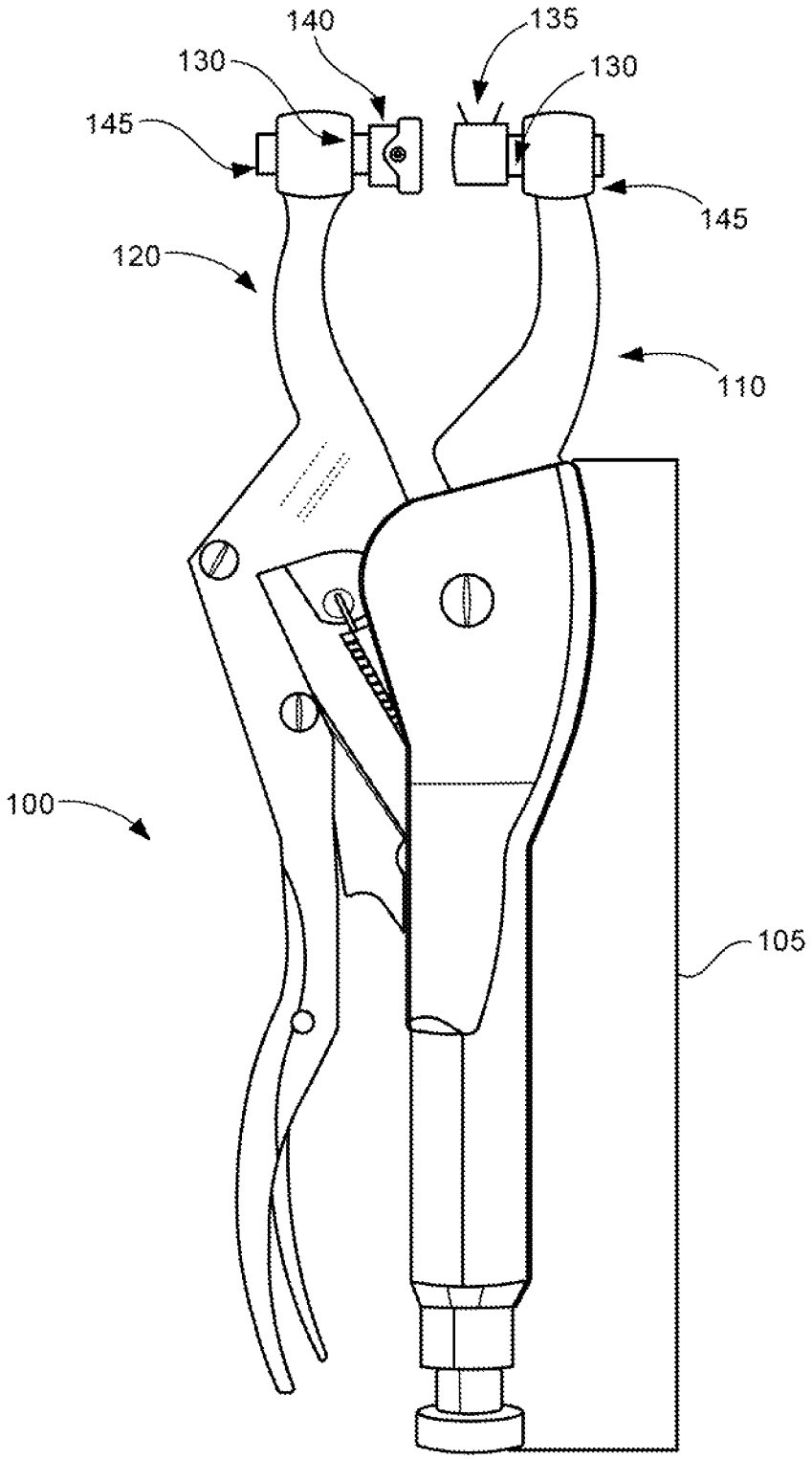
Figure 1C:
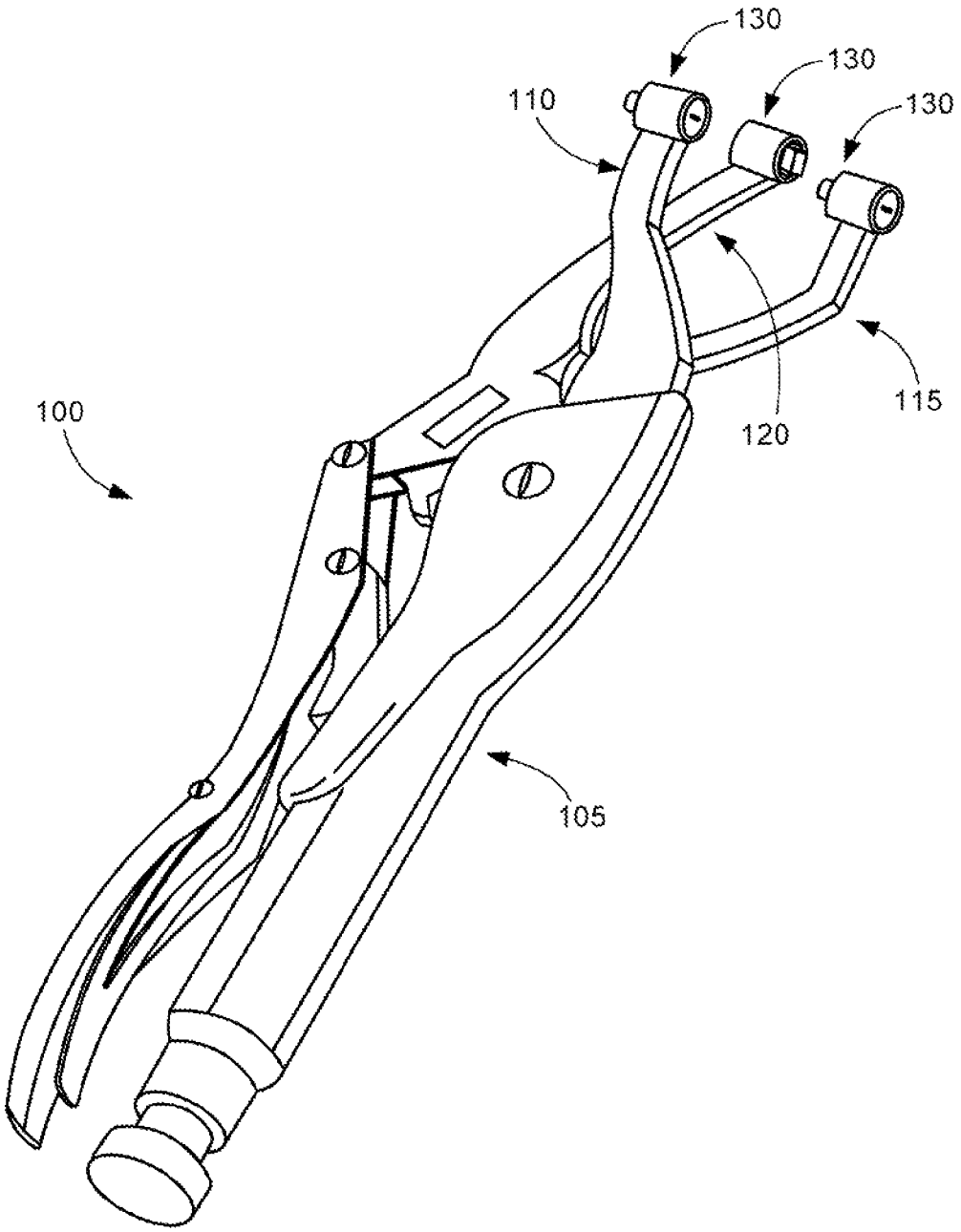

FIGS. 1A, 1B, and 1C are illustrations of an exemplary device that holds two or more parts together on the same plane to prevent a bolt from turning or tipping while leaving both hands free to install or to remove a nut, in which FIG. 1A is a top view, FIG. 1B is a side view, and FIG. 1C is an angle view, in accordance with an embodiment of the present invention. In the present embodiment, device 100 comprises adjustable locking plier body 105, such as, without limitation, Vice Grip™, that incorporates a split-jaw top 108. In the present embodiment, the split jaw top 108 has a left jaw 110 and right jaw 115. The bottom is a centered jaw 120. In the present embodiment, the split top jaws 110 and 115 comprise equally spaced curved arms that extend from the body 105 to create a work space 125 between the jaws. In the present embodiment, the top jaws 110, 115, and bottom center jaw 120 may, without limitation, terminate three inches from the locking plier body 105 and, without limitation, may have a thickness of 0.125 inches. In a non-limiting example, the top split jaws left 110 and right 115, relative to the bottom center jaw 120, create three points of contact 130 with the work piece. In the present embodiment, the top jaw 108 may be stationary where the configuration of the split jaw left 110 and right 115 are positioned so that the bottom jaw 120 is allowed to be adjusted to the thickness of the work material thus creating a locking adjustable plier device 100. As the jaws are clamped on the work material, three total points of contact are made where two points will engage the material and one point will engage the bolt head. In a non-limiting example, the work space 125 is adjustable to accommodate variably sized bolt heads and nuts or as a fine tune adjustment for bolt hole pattern alignment.

In the present embodiment, each contact point 130 is designed to hold either a socket 135 or a swivel pad 140. In some embodiments, the spacing 125 between the split top jaws 110 and 115 may be designed to accommodate a specific bolt-hole pattern so two bolt heads can be engaged at the same time. In the present embodiment, the bottom jaw 120 is extended to a point directly between the contact points of the top split jaw left 110 and right 115. In some embodiments, the holding method, without limitation, may be a solid square drive of appropriate size to match the socket 135 and pad 140, a ratcheting square drive of appropriate size, or a hex-styled drive-bit receiver. In the present embodiment, a shallow pocket socket 135 is attached to contact point 130 of the bottom jaw 120, and swivel pad 140 is attached to contact point 130 of the top split jaw left 110 and right 115. In a non-limiting example, the top split jaws 110 and 115 may have either a swivel pad 140 or another socket 135 attached depending on whether the tool is designed for a specific bolt hole pattern and is engaging two bolt heads or just one bolt head. In the present embodiment, each shallow pocket socket 135 is designed to fit each sized bolt head on all six sides and the top. In a non-limiting example, when the jaws are clamped into place, the socket 135, in conjunction with the swivel pad 140, apply force to the bolt head and prevent the bolt from tipping as the nut is installed or removed. In another non-limiting example, each socket 135 may be interchangeable among the contact points 130. In the present embodiment, the overall height and depth specifications of the swivel pads 140 and the sockets 135 are identical, which allows each to be interchangeable.

Figure 2:
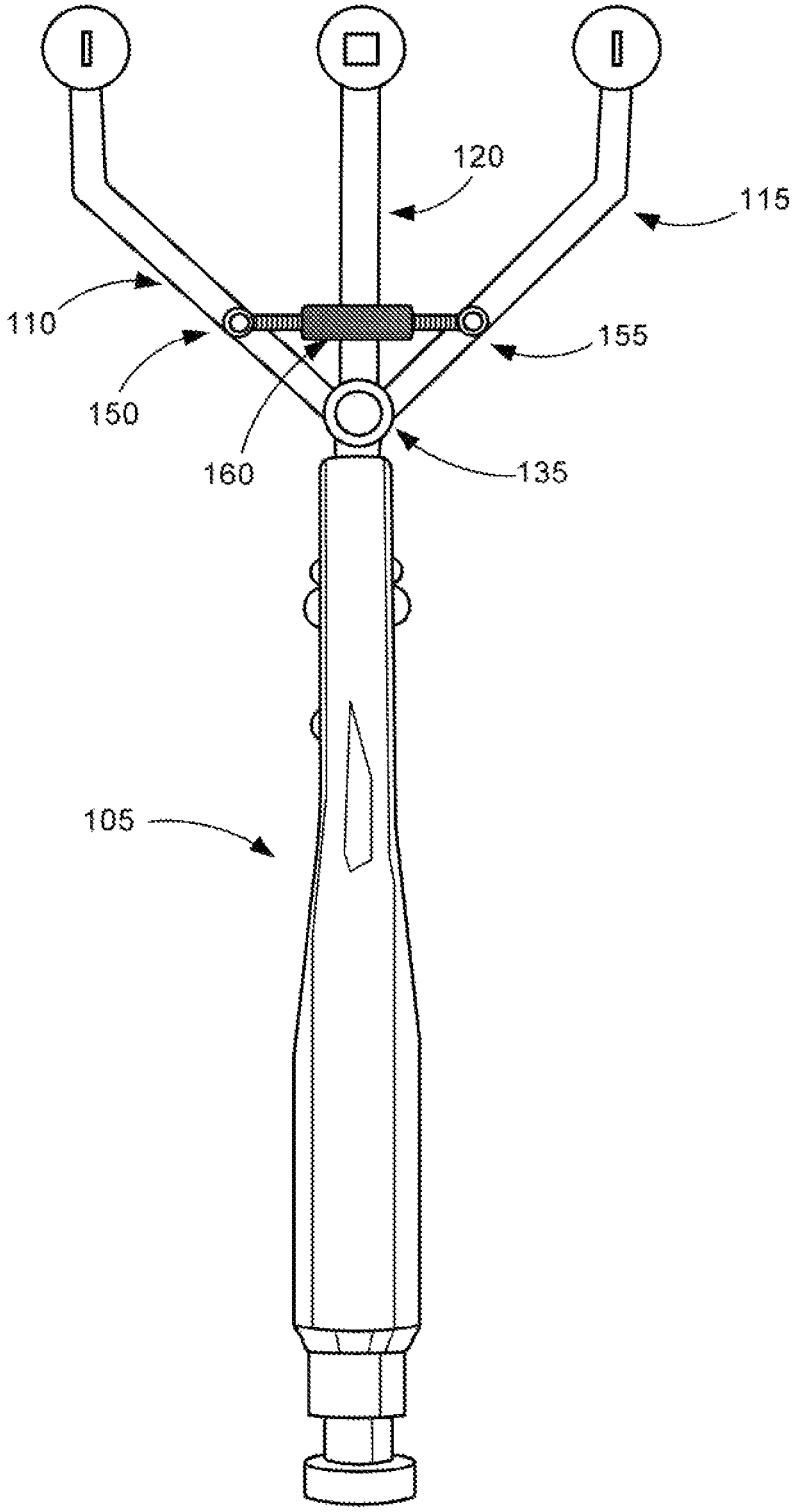
FIG. 2 is an illustration of an exemplary device with an adjustable work space, in accordance with an embodiment of the present invention.

FIG. 2 is an illustration of an exemplary device with an adjustable work space, in accordance with an embodiment of the present invention. In the present embodiment the top split jaws 110 and 115 may be joined at hinge 135. In a non-limiting example, hinge 135 may a include a pin or other means for allowing the top split jaws 110 and 115 to rotate about for changing a distance between them. In the present embodiment, a screw type portion 150 is joined to left jaw 110 and a screw type portion 155 is joined to right jaw 115. An adjustment wheel 160 joins screw portion 150 and screw portion 155 in a manner such that rotation of adjustment wheel 160 operates to change the distance between the top split jaws 110 and 115. In a non-limiting example, screw portion 150 may have a right-handed thread and screw portion 155 may have a left-handed thread.

Figure 3:
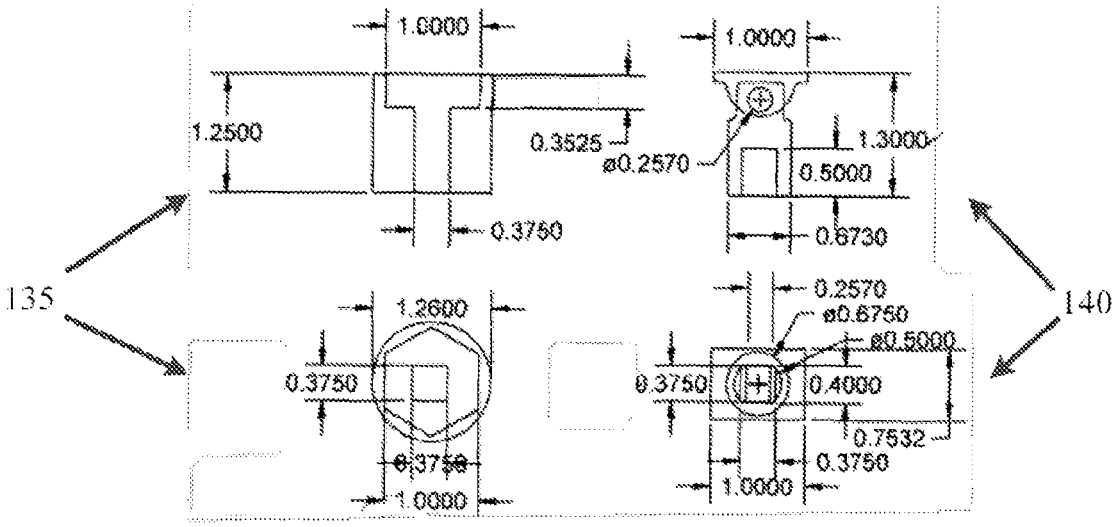
FIG. 3 is an illustration of an exemplary dimensions for swivel pads and sockets, in accordance with an embodiment of the present invention.

FIG. 3 is an illustration of an exemplary dimensions for swivel pads and sockets, in accordance with an embodiment of the present invention.

In some embodiments, the split top jaw left 110 and right 115, and the bottom center jaw 120 may terminate in a ¼", a ⅜", a ½", or a ¾" socket drive with an optional locking ratchet head 145. In a non-limiting example, the optional locking ratchet head 145 is best used when the device 100 is designed as a specialty tool to simultaneously stabilize two bolt heads.

In another embodiment, device 100 may be produced as a single-sized bolt stabilizer (left-, right- or center-mount) with no interchangeable parts.

In some embodiments, device 100 may be adjusted to desired thickness. In a non-limiting example, the thickness of device 100 may increase or decrease the pressure needed while freeing both hands once the tool is locked in place through adjusting the distance between bottom 120 and top split jaws 110 and 115 to allow for thickness of work piece and desired pressure.

In at least one embodiment, device 100 may accept available generic sockets.

In another embodiment, device 100 may accept alternate drivers for different types of bolts.

In another embodiment, device 100 may be produced with multiple bolt stabilizers that may be enhanced or neutralized with attachments as the work requires In some embodiments, without limitation, the size of the locking-pliers body 105 may vary according to the sizes of the socket drive and the bolts.

In an alternative embodiment, the size of the locking-pliers body 105 may vary to accommodate specific jobs.

In some embodiments, the split jaw left 110 and right 115 may be mounted to the bottom jaw of the body 105 and the bottom center jaw 120 mounted to the top jaw of body 105.

In another embodiment, device 100 may be used as a specialty tool. In a non-limiting example, split jaws 110 and 115 are set to match a desired bolt-hole pattern. Additionally, in a non-limiting example, the swivel pad 140 height and the socket 135 can be modified for use in any of the three drive positions.

In another embodiment, device 100 may be used to lock in place a bolt head to free the user's hands to slip on a gasket. In a non-limiting example, if the user is working on a bolt head, a socket on a single drive and a swivel pad on the split jaw 110 and 115 will suffice to clamp the bolt in place.

In some embodiments, the socket 135 may allow multiple jaw-drive positions. In a non-limiting example, having multiple jaw-drive positions allows the user to reach into corners, such as when working with steel shelves, and to use the socket 135 and to lock the bolt head into place while holding the work pieces together, thus freeing both hands.

In at least one embodiment, the socket 135 and swivel pad 140 may be made with the height of the pad 140 0.05" longer than the socket but the socket 135 depth 0.05" shorter than the height of the bolt head of that size; however, all of the sockets 135 in this set must be the same height but the depth of each socket 135 must be 0.05" less than the height of the bolt head of that size. In a non-limiting example, this configuration allows the socket 135 to engage the bolt head on all sides and the top to stabilize the bolt when using a ⅜" or ½" drive. Additionally, in a non-limiting example, by having the pad 140 0.05" longer than the socket 135, the pad 140 will simultaneously engage the work surface with the same force that the socket 135 engages the bolt head.

In an alternative embodiment, jaws 110, 115, and 120 may be fabricated from hardened steel, stainless steel, cast stainless steel, aluminum, cast aluminum, spring steel, brass, tool steel, hot roll steel or cold roll steel. Jaws may be forged, cast, laser cut and formed or machined. Existing manufacturing materials and methods may be used to modify the new jaw configurations.

In an alternative embodiment, the top jaw left 110 and right 115 may have pivot points at preset angles to help device 100 reach into tight areas and blind corners. In a non-limiting example, the pivot-point angles may be 15°, 30°, 45°, and 60°.

In an alternative embodiment, the pads 140 may be designed to hold cylindrical work.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All of the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that, according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a tool that holds two or more parts together on the same plane to prevent a bolt from turning or tipping while leaving both hands free to install or to remove a bolt and nut according to the present invention will be apparent to those skilled in the art. Various aspects of the invention have been described above by way of illustration, and the specific embodiments disclosed are not intended to limit the invention to the particular forms disclosed. The particular implementation of the tool that holds two or more parts together on the same plane to prevent a bolt from turning or tipping while leaving both hands free to install or to remove a bolt and nut may vary depending upon the particular context or application. By way of example, and not limitation, the tool that holds two or more parts together on the same plane to prevent a bolt from turning or tipping while leaving both hands free to install or to remove a bolt and nut described in the foregoing were principally directed to industrial and manufacturing implementations; however, similar techniques may instead be applied using magnetic locking or grip type tools which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprising:

an adjustable locking plier body;

a split jaw top being joined to said plier body, said split jaw top comprising a left jaw and a right jaw, said left jaw and said right jaw being separated by a distance;

a bottom jaw being joined to said plier body, said bottom jaw being generally centered on said distance, wherein said bottom jaw and said split top jaw are operative for clamping a work piece inserted between said bottom jaw and said split jaw top;

at least one socket being configured for engaging at least one of, said left jaw, said right jaw and said bottom jaw for engaging a bolt head of said work piece; and in which at least one of, said left jaw, said right jaw and said bottom jaw further comprises a socket drive for engaging said at least one socket.

2. The apparatus as recited in claim 1, further comprising at least one locking ratchet head being configured for engaging said at least one socket drive.

3. The apparatus as recited in claim 1, further comprising at least one swivel pad being configured for engaging a one of said left jaw, said right jaw and said bottom jaw for engaging a surface of the work piece.

4. The apparatus as recited in claim 3, in which said socket drive is further configured for engaging said at least one swivel pad.

5. The apparatus as recited in claim 1, further comprising an adjustment mechanism being configured for adjusting said distance.

6. The apparatus as recited in claim 5, in which said adjustment mechanism comprises a hinge for enabling said left jaw and said right jaw to rotate.

7. The apparatus as recited in claim 6, in which said adjustment mechanism further comprises an adjustment wheel being configured for rotating said left jaw and said right jaw for adjusting said distance.

8. The apparatus as recited in claim 7, in which said adjustment mechanism further comprises screw type portions joined to said left jaw and said right jaw, said screw type portions being in engagement with said adjustment wheel.

9. The apparatus as recited in claim 8, in which a one of said screw portions has an opposite handedness of the other screw portion.

10. The apparatus as recited in claim 1, in which said at least one socket further comprises a pocket for receiving the bolt head.

11. The apparatus as recited in claim 10, in which a depth of said pocket is less than a height of the bolt head.

12. The apparatus as recited in claim 1, further comprising a second socket for engaging a second bolt head of the work piece at the same time as the bolt head.

13. An apparatus comprising:

an adjustable locking plier body;

means for contacting a work piece at two positions separated by a distance;

means for contacting an opposing said of the work piece generally centered on said distance, wherein said means for contacting are operative for clamping a work piece;

means for ratcheting said means for contacting; and means for adjusting said distance.

14. The apparatus as recited in claim 13, further comprising means for engaging a bolt head of the work piece.

15. An apparatus comprising:

an adjustable locking plier body;

a split jaw top being joined to said plier body, said split jaw top comprising a left jaw and a right jaw, said left jaw and said right jaw being separated by a distance;

a bottom jaw being joined to said plier body, said bottom jaw being generally centered on said distance, wherein said bottom jaw and said split top jaw are operative for clamping a work piece inserted between said bottom jaw and said split jaw top;

at least one socket being configured for engaging a one of said left jaw, said right jaw and said bottom jaw for engaging a bolt head of the work piece, in which at least one of said left jaw, said right jaw and said bottom jaw further comprises a socket drive for engaging said at least one socket, said at least one socket further comprising a pocket for receiving the bolt head, in which a depth of said pocket is less than a height of the bolt head;

at least one locking ratchet head being configured for engaging said at least one socket drive;

at least one swivel pad being configured for engaging a one of said left jaw, said right jaw and said bottom jaw for engaging a surface of the work piece; and an adjustment mechanism being configured for adjusting said distance, said adjustment mechanism comprising: a hinge for enabling said left jaw and said right jaw to rotate; screw type portions joined to said left jaw and said right jaw, in which a one of said screw portions has an opposite handedness of the other screw portion; and an adjustment wheel, in engagement with said screw type portions and being configured for rotating said left jaw and said right jaw for adjusting said distance.

* * * * *